United States Patent [19]

Last

[11] Patent Number: 4,939,798

[45] Date of Patent: Jul. 10, 1990

[54] LEADING EDGE AND TRACK SLIDER SYSTEM FOR AN AUTOMATIC SWIMMING POOL COVER

[76] Inventor: Harry J. Last, 1246 Birchwood Dr., Sunnyvale, Calif. 94089

[21] Appl. No.: 258,000

[22] Filed: Oct. 17, 1988

[51] Int. Cl.[5] ..... E04H 3/19

[52] U.S. Cl. ..... 4/502

[58] Field of Search ..... 4/502, 498

[56] References Cited

U.S. PATENT DOCUMENTS

| | | | |
|---|---|---|---|
| 3,019,450 | 2/1962 | Karasiewicz | 4/172 |
| 3,747,132 | 7/1973 | Foster | 4/172.14 |
| 3,982,286 | 9/1976 | Foster | 4/174.14 |
| 4,001,900 | 1/1977 | Lamb | 4/172.14 |
| 4,060,860 | 12/1977 | Lamb | 4/172.14 |
| 4,686,717 | 8/1987 | MacDonald et al. | 4/502 |

FOREIGN PATENT DOCUMENTS 2072006 9/1980 United Kingdom .

OTHER PUBLICATIONS

1985 Homeowner Manual for the AquaMatic Pool Cover System authored by the applicant, Harry J. Last, for his company, AMCS, Inc.

"History of the Automatic Pool Cover" prepared by the applicant, Harry J. Last and used for promotion of the automatic pool cover system manufactured by AMCS, Inc. and marketed under the trademark Aqua-Matic beginning Jul. 1988.

*Primary Examiner*—Charles E. Phillips

*Attorney, Agent, or Firm*—David E. Newhouse

[57] ABSTRACT

A leading edge and track slider system for automatic swimming pool covers which carries the front edge of the swimming pool cover as it is drawn across to cover or uncover a swimming pool includes a rigid structural boom having a flat or planer longitudinal surface with "C" channel along one edge of the flat surface receiving and capturing a front beaded edge of the pool cover. Connecting plates, secured to the flat surface of the boom, pivotally couple the ends of the boom to a pair slider elements each having a hollow cylindrical sliding edge captured and sliding within a "C" channel of conventional swimming pool cover track secured on either side of the pool. The pivotal coupling between the connecting plate and slider element is achieved by a bolt translating in a slot cut through the slider element oriented perpendicularly relative to the direction of cover travel as it is drawn across the pool. The cables or ropes extending from the beaded side edges of the pool cover each thread a hollow cylindrical sliding edge of a slider element and connect to a take-up reel of the drive mechanism. Each slider element is anchored to the cable or rope threading its hollow cylindrical sliding edge by a plurality screws with a smooth shank having a diameter less than the thickness of a necked section joining to the hollow cylindrical sliding edge and a length extending beyond the necked section into the main body of the slider element.

50 Claims, 7 Drawing Sheets

LEADING EDGE AND TRACK SLIDER SYSTEM FOR AN AUTOMATIC SWIMMING POOL COVER

BACKGROUND OF THE INVENTION

1. Field of the Invention

The invention relates to automatic swimming pool cover systems and, in particular, to the mechanisms and devices for carrying the front edge of the pool cover across the pool above water level.

2. Description of the Prior Art

Automatic swimming pool cover systems typically include a flexible vinyl fabric which is sized so that most of it floats on the water surface of the swimming pool. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or the the underside of an overhanging coping along the sides of the swimming pool. The cables extending from the beaded tape sections of the cover are trained around pulleys at the distal ends of the tracks and return in a parallel "C" channel to a drive mechanism where they wind onto cable take-up reels.

To uncover the pool, the drive mechanism rotatably drives a cover drum mounted at one end of the pool winding the pool cover around its periphery unwinding the cables from the take-up reels. To cover the pool the drive mechanism rotatably drives the cable take-up reels winding up the cables to pull the cover across the pool unwinding the cover from the cover drum.

The rate at which the pool cover unwinds from and winds onto the cover drum depends on the diameter of the roll of the cover still wound around the drum, i.e., the rate is greatest when most the cover is wound around the drum (largest diameter) and least when the cover is practically unwound from the drum (least diameter). The same phenomenon occurs as the cables wind onto and unwind from the cable reels. It should be appreciated that the cables wind onto the cable reels at the highest rate when the cover unwinds from the cover drum at its lowest rate and visa versa In systems where the cable take-up reels and the cover drum are on the same shaft and rotate at the same rate, a spring is utilized as a tensioning take-up mechanism to compensate for the different and varying rates at which the cables and pool cover wind and unwind from the respective reels and drum during the opening and closing cycles. The spring mechanism lengthens and shortens the cable path as the cover is drawn back and forth across the pool taking up and yielding slack in the respective cables as necessary to compensate for the difference in the winding and unwinding rates of the reels and drum. [See U.S. Pat. Nos. 3,747,132 & 3,982,286, Foster.]

In other systems a clutching mechanism is utilized to decouple the rotation of the cable reels from that of the cover drum as it is rotatably driven to wind the cover onto the drum uncovering the pool, and to decouple the rotation of the cover drum from that of the cable reels as they are rotatably driven to draw the cover across the pool. Typically, in such systems, the cable reels are allowed to free wheel when the cover drum is rotatably driven and conversely, the cover drum to free wheel when the cable reels are rotatably driven. [See U.S. Pat. Nos. 3,019,450 and 3,050,743, Lamb.]

In early automatic pool cover systems the rigid boom spanning the width of the pool holding the front edge of the cover above the water was typically supported by a pair of wheeled dollies rolling on the side edges of the pool. The cables moving within the "C" channels of the track along either side of the pool were either directly secured in some fashion to the rigid boom, [Foster, supra], or were indirectly secured to the ends of the boom via fabric interfaces referred to as gores. [See U.S. Pat. No. 4,001,900, Lamb].

It should be appreciated that in such early systems debris such as towels, dirt, and leaves left at the edge of the pool, as well as irregularities in the path of the wheeled dollies, would disrupt both extension and retraction of the cover and frequently caused the rigid boom to bind either ripping the fabric interface coupling the ends of the boom to the cables or pulling the beaded side edges of the pool cover out of the track. And in instances of direct couplings between the rigid boom and cables, such binding could cause sufficient skewing to allow the boom to drop into the pool. Also folds in the cover and its beaded edge as it winds onto the cover drum during retraction would frequently cause skewing and binding of the rigid boom because of unequal winding, transversely, of the cover around the cover drum.

A factor which greatly complicates the extension and retraction of automatic pool covers across a swimming pool is the requirement for the cover to have sufficient slack both transversely and longitudinally to enable it to float on the water surface as it was extended and retracted. Accordingly, attempts have been made to configure the fabric interfaces (gores) coupling the cables to ends of the rigid boom in such a manner as to preclude transverse tension at the front corners of the cover and yet provide for longitudinal tension necessary for unwinding the cover from the cover drum during extension and for pulling the rigid boom back during retraction.

Ameliorating the complexity of stress transfer problems at the junction between the front edge of the cover, the cables and the rigid boom, is the fact that each beaded tape side edge of the cover and cable extending to the take-up reel comprise a single mechanical tensioning element that has both the capacity to carry a portion of the longitudinal tension load on the body of the cover during extension and retraction and the capacity to overcome the friction load of the beaded edges sliding within the "C" channels of the track. [See U.S. Pat. No. 4,060,860, Lamb.]

The result of the above interacting factors has been an interface fabric attached at the front corners of the cover which was designed to allow the cover to billow transversely but which maintained the longitudinal tensional integrity of the beaded edge and cable.

The primary problem with such with such fabric interfaces is that flexibility exists in the coupling between the boom and cables which allows the boom to easily skew transversely between the tracks. Such skewing unequally loads or strains the cover fabric at the front corners and causes the cover wind crookedly onto the cover drum during retraction. Also, such fabric interfaces tend to wear excessively because of the variety of tension loading experienced during extension and retraction of the cover. Also, a billowing interface fabric tends to slide and excessively wear on the coping at the edges of the pool during extension and retraction in addition to trapping debris at the front corner edges of the cover. When combined with the effects of moisture, pool chemicals and sunlight, the above factors cause such fabric interfaces to deteriorate at a faster rate than the remainder of the cover.

Other disadvantages of fabric interfaces connecting between cables cover and rigid boom related to the practical impossibility to provide a standard manufacturing design because of variations in pool widths, and variations in the distances between the level of the track and the level of the water between different swimming pools. Also shrinkage of the cover fabric due to the effects of sun, pool chemicals, and temperature complicate the design of such fabric interfaces.

Because of the problems with wheeled dollies for supporting the rigid boom spanning the pool, in 1981 the applicant began experimenting with various types of slider mechanisms which were captured by and slid in a "C" channel of the track for mechanically supporting the rigid boom spanning the pool above water level. However, tracks with separate slider channels are the exception in the pool cover industry, and track replacement is not feasible for the installed base of pool covers. The industry, following the lead of the applicant, has for the most part adopted various different types of sliding mechanisms which have today supplanted the use of wheeled dollies for supporting the rigid boom spanning the pool above the water level. (See, for example, U.S. Pat. No. 4,686,717, MacDonald et al. & U.K. Pat. No. 2,072,006, Lee.)

However, while such slider mechanisms provide an opportunity for direct connection between the ends of the rigid boom and the cables, they also introduce a host of additional mechanical problems. First, such sliding mechanisms are extremely sensitive to and can not tolerate any skewing of the rigid boom which causes the sliders to jam in the capturing track channels. Also, any forces tending to bow the rigid boom during extension and retraction will simultaneously tend to pull the sliders out of the slot opening of the capturing track channel and twist them twist horizontally causing them to jam. The tracks on either side of the pool must be exactly parallel with the spacing between them constant, otherwise the boom will bind. In short, any stress tending to bend the boom or rotate it either longitudinally, transversely or both will cause the sliders jam in the capturing channel of the track.

Typically, separate channels in the track for capturing and carrying the sliders have been suggested (MacDonald et al. & Lee, supra) to eliminate problems inherent in having to accommodate both the cable and the sliders within the same channels. And in those instances where the slider and the cables coexist in the same channel of the track, the increased wear and stress loading of capturing channel can cause irregularities in the slot opening increasing the friction resistance of the beaded tape edge of the cover captured and sliding in the channel. Such stresses can also widen the slot opening of the capturing channels sufficiently to allow the bead tape edge to slip out of the channel.

The friction load of such slider mechanisms also tends to decouple the tensional integrity of the beaded tape edges of the cover and cables extending therefrom to the take-up reels. In essence, the frictional resistance of the sliders is a variable braking force analogous to that described in U.S. Pat. No. 4,060,860, Lamb, which can not be adjusted and which can unpredictably vary. For example, during cover retraction, a sudden increase of slider friction in one channel because of rotation or bowing of the rigid boom or a rough spot in one of the capturing track channels will increase the tension along one side of the cover inducing a diagonal stress across the cover which tends to pull the respective sliders out of the slot openings of the channels further increasing the frictional resistance of the resisting slider causing it to jam in place. During cover extension, such a sudden increase of slider friction in one of the channels induces the boom to skew again tending to pull the respective sliders against the slot openings of the capturing channels causing a jam. In either case, if the drive continues to rotate the cover drum and/or cable reels, upon a slider jamming in a capturing channel, the front edge of the cover can be ripped free of the boom.

The mechanical integrity of the junction between the sliding portion of the slider captured within the track channel and the section of the slider secured to the boom is also a problem.

In short, incorporation of a slider coupling for supporting the rigid boom above the water level of the pool significantly changes the nature of the mechanical linkage between the cables, the front cover edge, the front cover corners and the rigid boom necessary achieve a smooth and uniform extension and retraction of the cover.

SUMMARY OF THE INVENTION

A leading edge and track slider system is described for automatic swimming pool covers which carries the front edge of the swimming pool cover above the level of the water as it is drawn across a swimming pool. The essential components of the system include: (i) a rigid structural boom spanning the pool having a flat or planer longitudinal surface with "C" channel along one edge of the flat surface for receiving and capturing a front beaded edge of the pool cover; (ii) a pair slider elements or "sliders" each having a hollow cylindrical sliding edge adapted for capture and sliding within the "C" channel of conventional swimming pool cover track; (iii) connecting plates secured to the flat surface of the boom at either end for establishing a translating pivoting coupling between the ends of the boom and the slider elements; and (iv) one or more screws each having a smooth shank section with a length and diameter determined by dimensions of a grooved or necked section joining the hollow cylindrical sliding edge of the slider element to its body for anchoring the slider element onto the cable. The translating, pivotal coupling between the connecting plate and slider element is accomplished by means of a loosely snugged pin or bolt translating in a slot cut through the slider element oriented perpendicularly relative to its cylindrical sliding edge. Cables from the beaded tape side edges of the pool cover thread through the hollow cylindrical sliding edge of the slider element. The screws diametrically pierce through the hollow cylindrical sliding edge, through the cable threading it, and through the grooved or necked section into the body of the slider firmly anchoring the slider element onto the cable.

A particular novel advantage of the invented system relates to the flat or planer longitudinal surface of the rigid boom which mechanically assures, during assembly, that slider elements coupled to the boom at either end are not canted or rotated with respect to each other and locates and directs horizontal component of the tension stresses in the pool cover as it is drawn back and forth across the pool into approximately in the same plane as the pulling stresses exerted by cable tension via the coupling to the slider elements at the ends of the boom thus minimizing the twisting moments rotating the cylindrical sliding edges of the slider elements out of alignment within the "C" channel of the track, minimizing frictional resistance, and maximizing stress transfer from the cables to the front edge pool cover.

Another novel advantage of the invented system is that the anchor positions of the slider elements on the cables can be easily adjusted by simply removing the anchoring screws securing the sliders to the cables and sliding it along the cable to a new position and then again anchoring it with the screws. Such adjustments are frequently necessary to provide longitudinal slack in the pool cover to compensate for such factors as cover shrinkage, and/or strain (stretching) of the beaded tape edges of the cover and/or associated cables, to assure alignment of the cover relative to the cover drum, the rigid boom, the underlying pool opening and to compensate for seasonal variations of water level in the pool.

A principal advantage of the invented system is that the direct anchoring of the sliders to the cables enables the position of the rigid boom to be adjusted relative to the front corner edges of the cover to maintain a desired difference in tension between the sides sections and central section of the cover eliminating the necessity for specially designing fabric interfaces coupling the rigid boom, pool cover and cables. In fact, with the invented system, by appropriately tailoring the front edge of the cover, it is possible to provide a longitudinally billowing cover with relatively taunt front corners which do not drag along the surfaces at the edges of the pool yet allow the front central section of the cover to billow or drape down and be supported by the pool water as the cover is drawn to and fro across the pool behind the rigid boom.

Still other novel aspects of the invented system relate to the smooth shanks of the screws anchoring the slider elements to the cables which will not gouge the lip openings of the "C" channels of the tracks as the necked section of the slider elements wear.

Also, the loosely snugged pin or bolt translating in the longitudinal slots cut through the sliders provide couplings at the respective ends of the boom (i) allow for translation of the rigid boom due to variations in the distance between the tracks secured along side the pool, (ii) allow the rigid boom to skew transversely between the tracks as it is drawn back and forth across the pool, and allow the boom to bow within limits without inducing stresses tending to pull the respective sliders out of the capturing "C" channels of the track.

A significant novel aspect of the invented system relates to offsetting the hollow passage drilled through the circular cross-section of the cylindrical sliding edge of the slider to mechanically strengthen the junction of the cylindrical sliding edge to the necked portion. Also, the cylindrical sliding edge of the slider can be notched or eliminated between anchor points to both to reduce friction and to allow for minor curvature in the capturing "C" channel.

Still other novel features of the invented system relates to the choice of slider materials with appropriate properties such as self lubrication, flexibility, toughness and hardness to minimize the wearing of the "C" channel of the extruded track, and to dimensioning the inside passageway of the hollow cylindrical sliding edge to slightly compress the cables threading it such that the anchoring pins are loaded in shear.

Finally, a cable access slot oriented perpendicularly with respect to the plane of the slider, can be cut into the hollow cylindrical sliding edge, a feature which allows the sliders to be placed and anchored on cables for upgrading existing pool cover systems having conventional "C" channel track without disconnecting the cable linkage between the cover and take-up reels.

Other advantageous novel features of the invented leading edge and slider system are that the slider element provides a means for splicing of new and even different types of cables to the cover, and that a worn or broken slider can be replaced "on line" by cutting a longitudinal slot opening into hollow cylindrical sliding edge of the replacement slider allowing it to be slipped around and fastened to a cable.

Still other features, aspects, advantages and objects presented and accomplished by the invented leading edge and track slider system will become apparent and/or be more fully understood with reference to the following description and detailed drawings.

DESCRIPTION OF PREFERRED AND EXEMPLARY EMBODIMENTS

Figure 1:
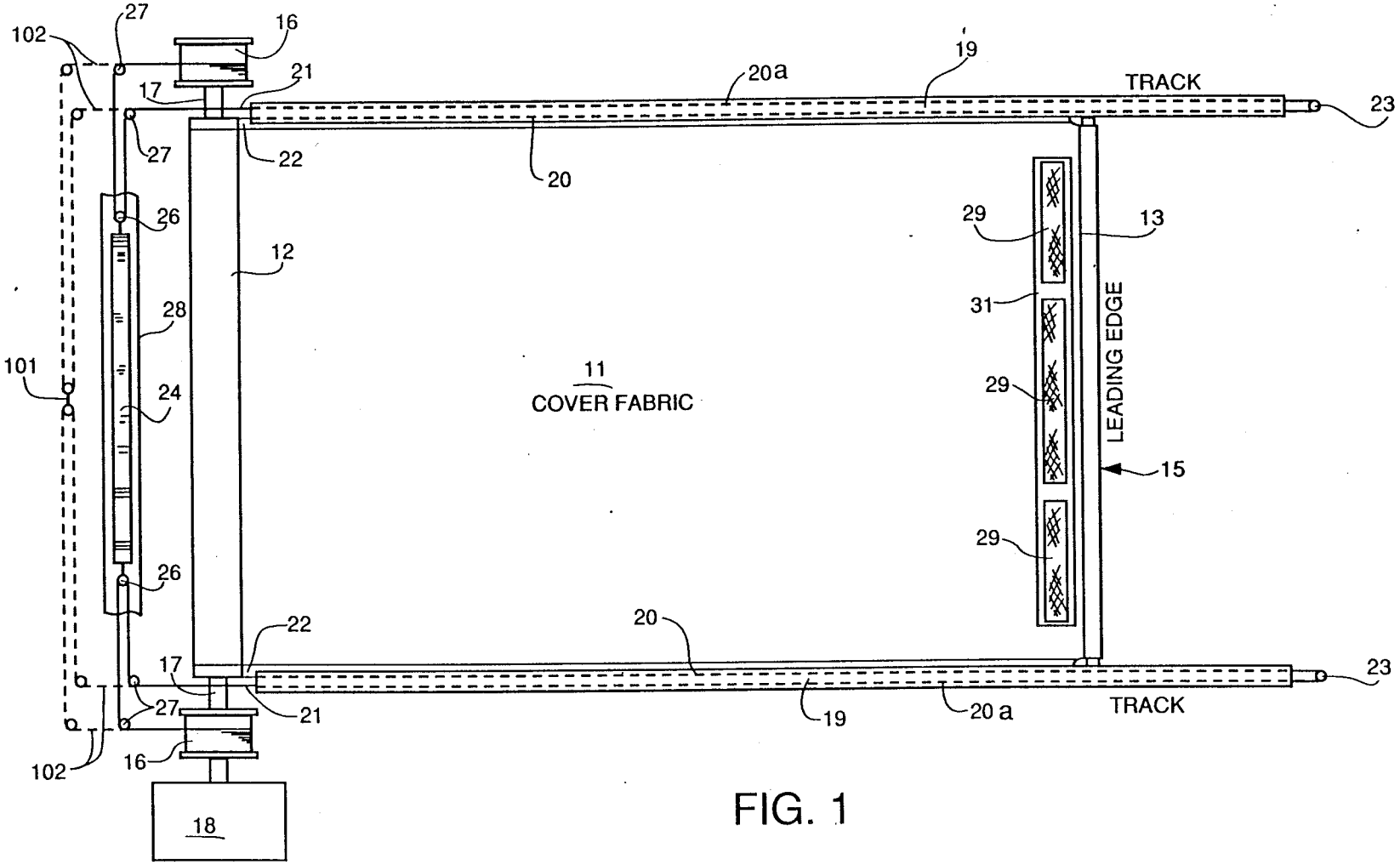
FIG. 1 is a top view line diagram showing the elements of an automatic swimming pool cover system incorporating the invented leading edge and slider system.

Referring to FIG. 1, an automatic pool cover with the invented leading edge and slider system includes a flexible vinyl fabric cover 11, attached for winding around a cylindrical cover drum 12 supported for rotation at one end of a swimming pool (not shown). The front edge 13 of the cover 11 is supported by a rigid leading edge 15 spanning the width of the pool above water level between a pair of parallel conventional extruded Aluminum "C" channel swimming pool tracks 19. (See FIGS. 7 and 8) Cables 21, typically a Dacron line, are incoporated into and form a beaded tape 22 sewn to the side edges of the cover 11. The cables 21 extend from the front corners of the cover 11, are trained around pulleys 23 at the distal ends of the tracks 19, and return within the parallel return channels 20*a* of the track 19 to ultimately connect with and wind onto a pair of cable take-up reels 16. The beaded tapes 22 sewn to the side edges of the cover 11 are captured and slide within the "C" channels 20 of the tracks 19. (FIG. 2) The cable take-up reels 16 are journaled to shafts 17 extending from the cover drum 12. A reversible motorized drive 18 is connected to one of the extending shafts 17 for rotating the cover drum 12 and take-up reels 16.

Since the cover drum 12 and take-up reels 16 rotate on the same shaft and at the same rate, a floating helical spring 24 with a pulley 26 secured at each end functions as a tensioning take-up mechanism to compensate for the different and varying rates at which the cover 11 and cables 21 wind and unwind from the drum 12 and the take-up reels 16 respectively. It should be appreciated, that the cables 21 wind around the take-up reels 16 in a direction opposite to that which the cover 11 winds around the cover drum 12. Accordingly, the cables 21 unwind from the take-up reels as the cover winds around the cover drum, and visa versa.

Pulleys 27 are incorporated into the respective cable paths to implement the necessary changes in direction of the cables 21 between the tracks 19 and the take-up reels 16 for coupling the pulleys 26 at the ends of the floating spring 24 into the cable system. The floating spring 24 is placed within a PVC tube 28 as a safety precaution to prevent debris and fingers from being captured between its extending and contracting helical coils during retraction and extension of the cover 11.

Figure 1A:
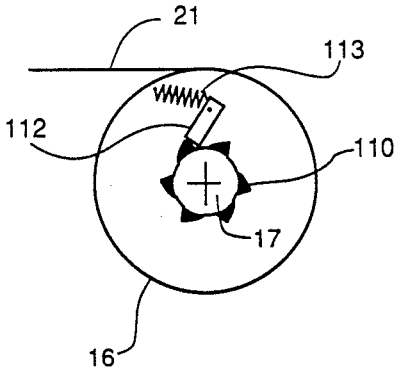
FIG. 1*a* is a simple diagram illustrating the components of a conventional releasable ratcheting mechanism.

Conventional releasable ratcheting mechanism diagrammed in FIG. 1*a* are incorporated into the journal couplings of the take-up reels 16 and the shafts 17 extending from the cover drum 12. Such ratcheting mechanisms typically include a stepped surface 111 integral with the circumferential surface of the shaft 17 or a coaxial circumferential surface carried by the take-up reel 16. A dog 112 pivotally secured at one end to either the reel 16 or shaft 17 respectively engages the stepped surface 111 when the stepped surface rotates in one direction and slides over the stepped surface 111 when it rotates in the opposite direction. A compression or tension spring 113 is typically utilized to force the dog against the stepped surface. To release such ratcheting mechanisms the dog is lifted out of engagement with the stepped surface allowing the shaft 17 and reel 16 each to free wheel independent of the other.

The ratcheting mechanisms allow the take-up reels 16 to be independently rotated on the shafts 17 to take up slack and adjust or pre-tension the cables 21, i.e., expand the spring 24. When required for maintenance, the ratcheting mechanism is released to allows the take-up reels 16 to free wheel on the shafts 17 relieving the tension and allowing slack in the cables 21.

It should be appreciated, that the take-up reels 16 essentially comprise a single reel partitioned by the cover drum 12. The reels 16 can be positioned adjacent to each other on a shaft 17 extending from either end of the cover drum 12, and, in fact, it is not even necessary to have a partition separating sections of the reel about which the respective cables 21 wind and unwind.

From the above it should be appreciated that two coupled closed loop cable paths are provided each of which at least incorporates, in sequence beginning at the rotatable cover drum 12 located at one end of the pool to which the pool cover 11 is attached and winds; (a) the beaded tape edge 22 sewn to the pool cover 11; (b) the slider element 34; (c) the end pulley 23 located at a distal end of the parallel track 19 relative to the cover drum 12 directing the cable 21 into return channels 20*a* within the pool cover track 19 adjacent the "C" channel 20; (d) the corner pulley 27 located proximate the cover drum aligned with the track return channel 20*a* for directing the cable 21 from the return channel 20*a* to the pulley 26 at the end of the floating spring 24; (e) the pulley 26 at the end of the floating spring 24; (f) the reel pulley 27 receiving the cable from the pulley 26 at the end of the floating spring 24 directing the cable 26 onto the take-up reel 16; and terminating at the take-up reel 16.

The ratcheting mechanisms incorporated into the journal couplings of the respective take-up reels 16 to the axle 17 are utilized to lengthen and shorten the respective cable paths as well as to center or adjust the position of the floating spring 24, e.g. shortening one of the cable paths with one of the ratcheting mechanisms translates the floating spring 24 between the pulleys 27 lengthening the other cable path when the other ratcheting mechanism is released.

Also, it should be appreciated that the floating spring 24 establishes and equalizes the tension loads on the respective cable paths. Accordingly, an increase in the friction load in one cable path always increases the tension load on both cable paths equally.

To extend the cover 11 across the pool, the driving mechanism 18 rotates the axle 17 in a first direction engaging the ratcheting mechanisms to simultaneously wind the cables 21 around the take-up reels 16 and unwind the cover 11 from the cover drum 12. Accordingly, the primary resistance retarding extension of the cover across the pool is limited to the friction of the sliders 34 and the beaded tapes 22 sliding within the "C" channels of the tracks and to the friction of the cover sliding across the surface of the water in the pool. The inertial resistance of the cover drum 12 and cover 11 wound around the drum 12 is carried directly by the driving means. Because of the differential in the travel of the cover 11 unwinding from the drum 12 and the cables 21 winding around the take-up reels 16, initially the spring 24 is expanded and the tension load on the cable paths is at a maximum. The tension load on the cable paths decreases as the leading edge approaches the mid-point across the pool, and then again begins to increase as the leading edge passes the midpoint and approaches the fully extended position abutting against the far end of the pool.

In contrast, when the cover 11 is retracted, the driving mechanism 18 rotates the axle 17 in the opposite to simultaneously unwind the cables 21 from the take-up reels 16 and wind the cover 11 around the cover drum 12. The ratcheting mechanisms prevent the take-up reels 16 from rotating at a faster rate than the axle, but will allow the axle to rotate at a faster rate than the take-up reels 16. It should be appreciated that the tension load imposed by the expanded floating spring 24 on the cable paths maintains the engagement of the ratcheting mechanism. And again because of the differential in travel of the cover 11 winding around the cover drum 12, and the cables unwinding from the take-up reels 16, the tension load on the cable paths decreases from a maximum at the fully extended position to a minimum at the half retracted position and then again increases to the maximum at the fully retracted position.

The actual position of minimum tension load may vary depending on the ratio of diameters of the cover drum 12 and the take-up reels 16. In fact, it is possible to utilize this property to adjust the point of minimum tension load on the cable paths by varying the initial (unwound) diameters of the take-up reels 16 coil layers of excess cable 21 and/or the initial (unwound) diameter of the cover drum 12 with layers of unused cover. The cover should be extended or retracted to the point of minimum tension loading on the cable paths before adjusting the pre-tension load of the cable paths accomplished by using the ratcheting mechanisms and rotating the take-up reels 16 as previously discussed.

Figure 4:
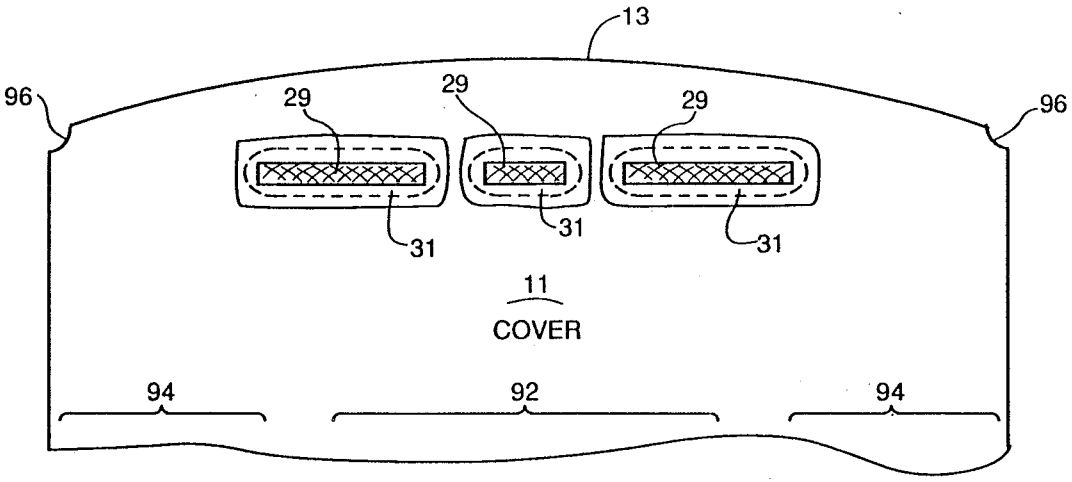
FIG. 4 illustrates the pattern of the front edge of a pool cover utilizing the invented leading edge and slider system.
Figure 3:
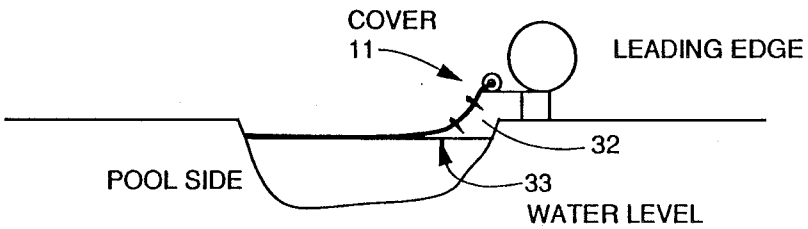
FIG. 3 is a line diagram illustrating the billow of the pool cover as it drapes from the "C" channel of the rigid boom to the pool water level.

As shown in FIG. 1, the cover 11 has several fine mesh screens 29 welded into it near its front edge. Floats 31 (FIG. 4) maybe incorporated into the welds to hold the screens 29 above the surface of the water when the cover 11 is drawn across the surface of the water. Alternatively, the mesh screens may be located in the billow region 32 (FIG. 3) of the cover 11 behind the rigid beam 14 such that the lower edge of the mesh opening is just above the pool water level 33 as the cover is drawn across the pool.

Care should be taken to locate the mesh screens 29 such that weight of the water collecting on the surface of the cover 11 does not excessively bow the leading edge 15 downward during retraction. The mesh screens 29 allow water collecting on the top of the cover 11 to drain into the pool as the cover is retracted uncovering the pool while retaining any solid debris on the surface of the cover. [See U.S. Pat. No. 3,982,286, Foster.]

Referring now to FIGS. 2-12 the principal components of the invented leading edge and slider system for carrying the front edge 13 of a pool cover 11 across a pool comprise an extruded Aluminum boom 14 having a flat bottom longitudinal surface 36 with a "C" channel 46 along its edge, a pair of sliders 34 each having a hollow cylindrical sliding edge 35 with an interior dimension sufficient to accommodate a cable 21 and exterior dimensions adapted for captured and sliding within a "C" channel 20 of conventional track 21, a pair of connecting plates 37 fastened to the flat bottom surface 36 at the respective ends of the boom 14, a pin or bolt 38 coupling each connecting plate 37 to a slider 34 translating in a longitudinal slot 39 cut though the body of the slider 34 oriented perpendicularly with respect to its hollow cylindrical sliding edge 35 enabling the coupling to simultaneously translate and pivot, and a plurality of smooth shank screws 41 diametrically piercing through the hollow cylindrical sliding edge 35 of each slider 34, through the cable 21 threading that cylindrical sliding edge 35 and through the grooved or necked section 43 of the slider 34 adjacent the cylindrical sliding edge 35 anchoring in the main body 44 of the slider 34.

Figure 2:
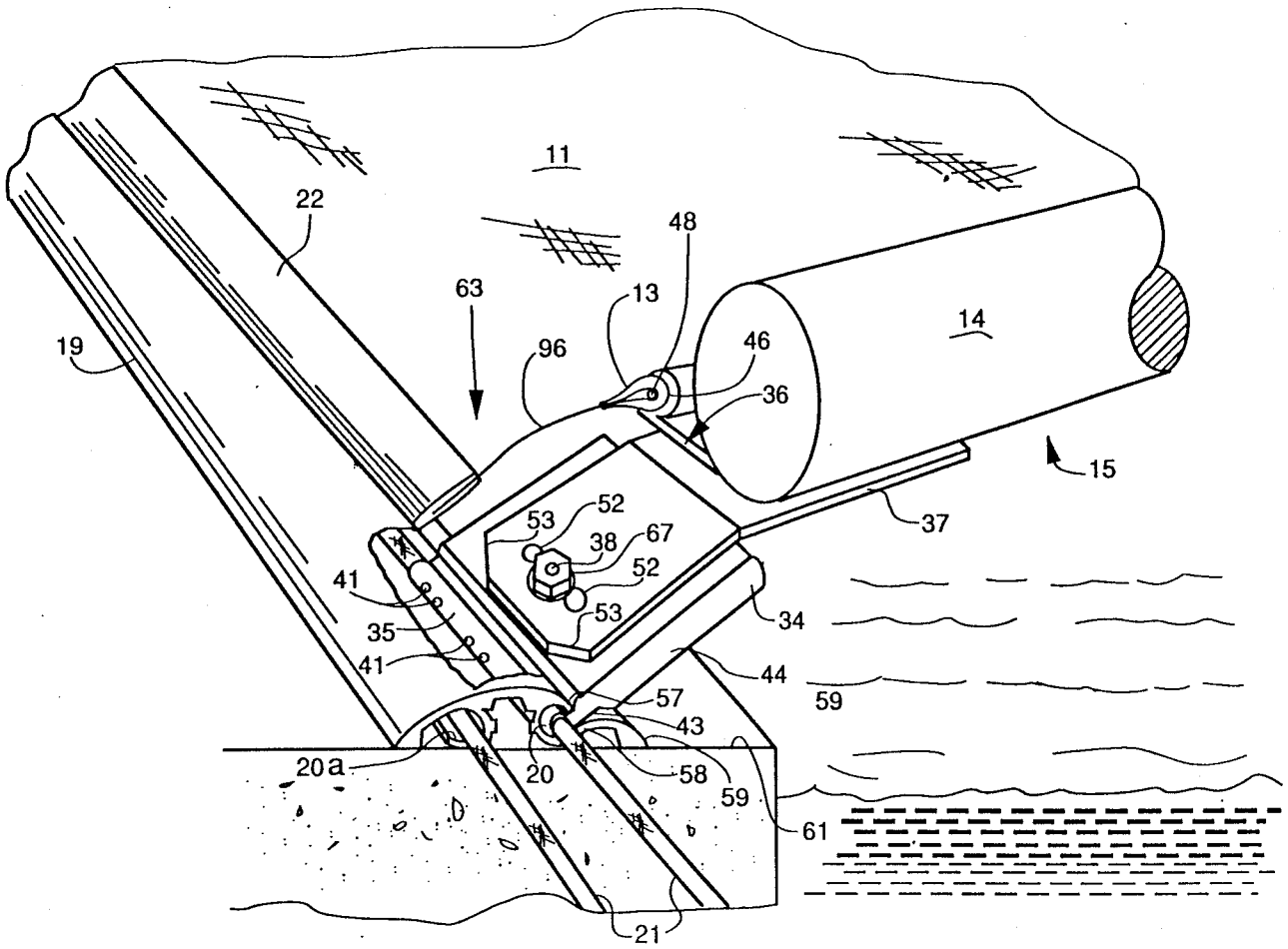
FIG. 2 is partial cut away perspective view of a front corner of a top track automatic pool cover system illustrating the relationship of the different elements of the invented leading edge and slider system.
Figure 6:
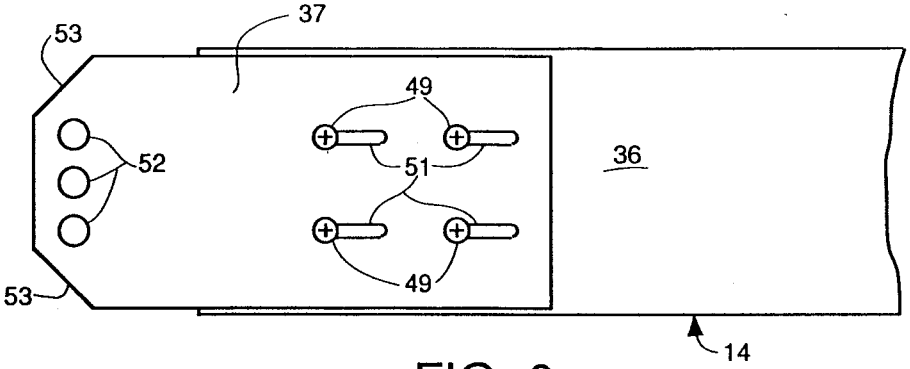
FIG. 6 is a bottom view of the rigid boom and connecting plate of the invented leading edge and slider system showing adjustment slots and connecting screws of the junction between the boom and connecting plate.
Figure 5:
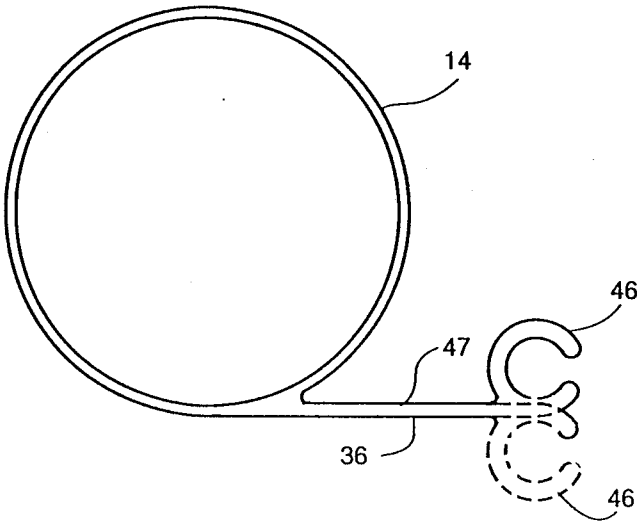
FIG. 5 illustrates a preferred cross configuration of the rigid boom of the invented leading edge and slider system.

In more detail, referring to FIGS. 2, 5, and 6, the extruded Aluminum boom 14 has a circular cross-section with a tangentially extending planer element 47 providing the flat bottom surface 36 with a conventional "C" channel 46 at its distal edge. A beaded front edge 48 of the cover 11 is captured within the "C" channel 46 of the boom 14. Each connecting plate 37 is tightly secured at each end of the boom 14 by four screens 49 anchoring in its flat bottom surface 36. Adjustment slots 51 oriented parallel to the longitudinal axis of the boom are cut through each connecting plate 37 receiving the screws 49 to allow adjustments in length of the boom and connecting plate extensions 37. The primary objective achieved by having an extruded boom 14 with a longitudinal flat bottom surface 36 is that the flat surface assures that the connecting plates 37 coupling to the sliders 34 are fastened to the boom in the same plane, i.e. not at different radial positions around the boom. Accordingly, stress imparted to the boom 14 via a cable 21 and slider 34 at one end of the boom will not tend to twist or turn the slider 34 coupled at the opposite end of the boom 14. It should be appreciated, that such twisting can cause the cylindrical sliding edges 35 of the sliders to jam in the "C" channels 20 of the track 19 as discussed below.

Mechanically, the connecting plates 37 function as longitudinal extensions of the tangential planer section 47 of the boom 14. Horizontal stress loads are imparted at the ends of the boom 14 at the couplings of the sliders 34 and the connecting plates 36 and along the length of the boom by the cover 11 captured by the "C" channel 46. Specifically, during extension and retraction of the cover 11, the tension of the cables coupled to the boom 14 and connecting plates 37 via the sliders 34 impart stresses at the ends of the boom 14 in the plane of the tangentially extending planar element 47, while the beaded front edge 48 of the cover 11 captured in the "C" channel 46 imparts an opposing horizontal stress distributed along the length of the boom 14. Ideally, by appropriate design, the opposing horizontal stress imparted at the ends of the boom 14 by the cables 21 and along the length of the boom by the cover 11 should be imparted in the same horizontal plane 9 in order to prevent an induced torsion stress acting on the boom tending to rotate such opposing stresses into alignment. When such ideal design is not achievable because of other design constraints, the perpendicular distance between the plane of the horizontal stresses imparted by the cables 21 and the plane of the horizontal stress imparted by the cover 11 along the length of the boom should be kept at a minimum in order to minimize the torsion stresses acting on the boom 14 and, ultimately, the respective sliders 34. For example, it may be possible to decrease the effective torque moment arms acting on the combine boom-slider mechanical system by locating the "C" channel 46 in a depending rather than a standing relationship with respect to the planer element 47 as indicated in phantom in FIG. 5.

Figure 7:
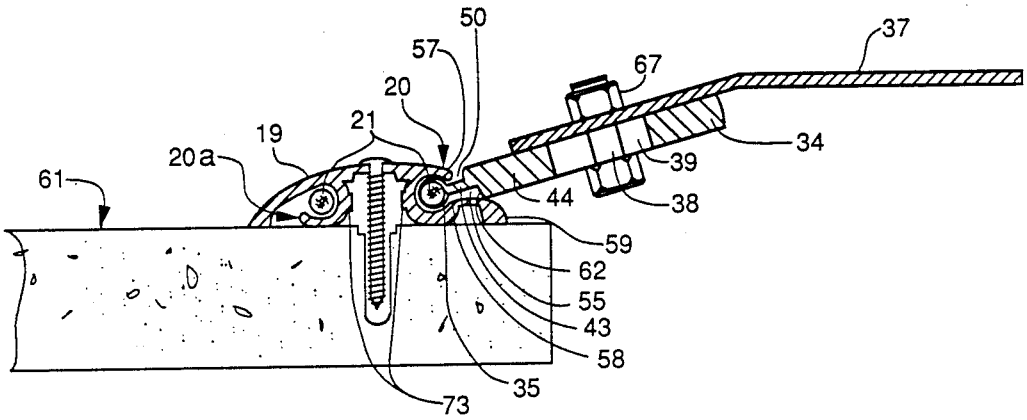
FIG. 7 is a cross-section view of conventional top "C" channel swimming pool track with a slider having a grooved or necked section configured to accommodate the "C" channels of such track.

As shown in FIGS. 2 and 7, for conventional top track systems, the connecting plates 37 must bent perpendicularly with respect to the axis of the boom 14 at an angle downward for proper coupling with the sliders 34. In particular, the plane bisecting the longitudinal slot opening of the "C" channel 20 of conventional extruded top track 19 is inclined acutely with respect to the surface to which it is secured constraining the slider 34 to slide in that inclined plane. In contrast, for under-track systems (FIG. 8), the connecting plates 37 extend horizontally from the flat bottom surface 36 of the boom for coupling to the sliders 34.

As shown in FIGS. 2 and 5, a plurality of holes 52 are drilled through each connecting plate 52 proximate its extending end for receiving the pin or bolt 38 coupling it to the slider 34. The holes 52 are are located along a line perpendicularly related to the longitudinal axis of the boom 14 and provide a mechanism for adjusting the transverse cant of the boom 14 relative to the positions of the slider 34 anchored on the cables 21. Such adjustment may be necessary in order to assure square alignment of the leading edge 15 with the end wall of a pool in the case of under-track systems, as well as to compensate for differential stretching and shrinkage of the cable 21 and beaded tapes 22 sewn to the sides of the cover 11. The distal corners 53 of the connecting plates 37 are beveled to provide sufficient clearance from the adjacent track 19 to allow the boom 14 to cant transversely during extension and retraction of the cover 11.

Referring now to FIGS. 2, 7, 8, 10–12, as previously described, the slider 34 has a hollow cylindrical sliding edge 35 shaped for capture and sliding within the "C" channel 20 of conventional swimming pool track 19. The hollow cylindrical sliding edge 35 of each slider 34 is obtained by cutting grooves 50 and 55 into the top and bottom surfaces 54 and 56 respectively of the slider 34 to provide a grooved or necked section 43 of a thickness slightly less than the width of the longitudinal slot opening of the "C" channel 20 of the track 19. The respective grooves 50 and 55 cut or molded into the top and bottom surfaces 54 and 56 of the slider 34 each should have a sufficient width to loosely accommodate the respective top and bottom lips 57 and 58 defining the longitudinal slot opening of the "C" channel 20 of the track 19.

As shown in FIGS. 2 and 7, for conventional top track, the width of the bottom lip 58 of the "C" channel 20 is somewhat greater than that of the top lip 57 in order to provide a longitudinal inside footing 59 supporting the track 19 on the pool deck 61. Accordingly, the bottom groove 55 is of greater width than the top groove 50. Also, it is possible to provide an inclined interior shoulder 62 to the bottom groove 55 to strengthen the configuration of the necked section 43 The narrower top groove 50 cut into the top surface 54 of slider adapted for top track also increases the structural strength and durability of the necked section 43.

Figure 8:
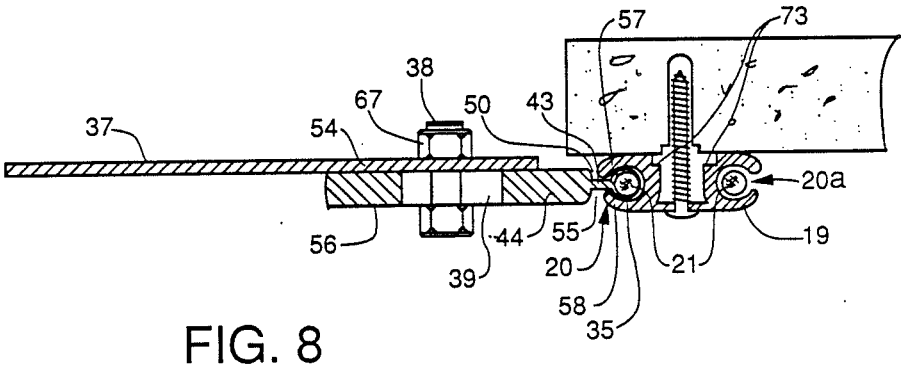
FIG. 8 is a cross-sectional view of conventional under "C" channel swimming pool track with a slider having a grooved or necked section configured to accommodate the "C" channel of such track.
Figure 10:
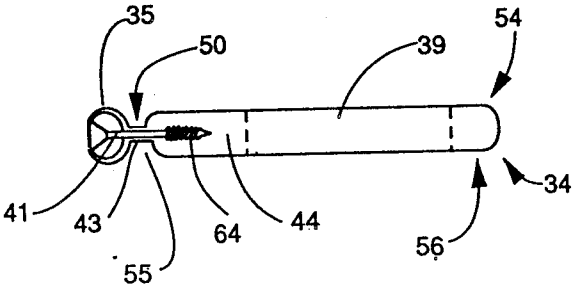
FIG. 10 is a cross-section illustration of the slider of the invented leading edge and slider system showing the smooth shank of the anchor screws diametrically piercing the hollow cylindrical sliding edge, the threading cable and the grooved or necked section of the slider as well as the preferred offset of the passageway drilled through that edge.

In contrast, referring to FIGS. 8 and 10, the lips 57 and 58 defining the longitudinal slot opening of conventional under swimming pool track 19 are approximately the same width, and accordingly, the top and bottom grooves 50 and 55 cut into the top and bottom surfaces 54 and 56 of the slider 34 should be of approximately the same width.

As shown in FIGS. 2, 7, 8, 10 and 10*a*, the cable 21 extending from the beaded tape 22 at the front corner 63 of cover 11 threads the hollow cylindrical sliding edge 35 of the slider 34 captured and sliding within the "C" channel 20 of the track 19. It is essential to provide greater strength at the junction of the hollow cylindrical sliding edge 35 and the necked section 43 joining it to the main body 44 of the slider 34. In particular, the junction section of the slider 34 between the sliding edge 35 and the necked section 43 is highly stressed and a primary wearing interface engaging the confining lips 57 and 58 of the "C" channel 20. Offsetting the cylindrical passageway toward the front wall of the cylindrical sliding edge 35 thickening the wall of the hollow cylindrical sliding edge in the section adjoining the necked section 43, will both provide additional strength and wearability. [see FIGS. 10 and 10*a*].

Figure 10A:
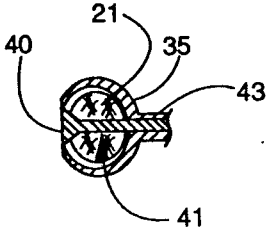
FIG. 10*a* is an enlarged cross-section view of the circled portion of FIG. 10 showing the hollow cylindrical sliding edge, the anchoring screw and the grooved or necked section of the slider of the invented leading edge and slider system.

As illustrated in FIGS. 10 and 10*a*, a plurality of smooth shank screws 41 diametrically pierce through the front wall of the hollow cylindrical sliding edge, through the cable threading the cylindrical passageway and through the necked section 43 to engage the main body 44 of the slider 34 with a conventional helical thread 64 firmly anchoring the slider 34 in position on the cable 21. The screws 41 have conical heads 40 of a diameter less than the radius of the sliding edge 35, and smooth shanks 45 in order to preclude gouging of the of the interior and the enclosing lips 57 and 58 of the "C" channel 20 of the track 19. In particular, as the necked section 43 of the slider 34 is worn down by the sliding engagement with the "C" channel lips 57 and 58 the shanks 45 of the screws are exposed. Accordingly, the length of the smooth shanks 45 of the screws 41 should always be greater than distance measured from the front wall of the hollow cylindrical sliding edge 35 to the interior shoulder 62 of the widest groove 50 or 55 defining the necked section 43.

Also, to prevent gouging within the "C" channel by the heads 66 of the screws 41, the conical heads 40 should be counter sunk into the thin front wall of the hollow cylindrical sliding edge 35 of the slider 34.

The hollow cylindrical sliding edge 35 of the slider 34 functions as a stiff lubricating sheath around the cable 21 for facilitating and directing stress transfer between the cable 21 the the slider 34. To maximize stress transfer, the cable and slider materials should be of comparable rigidity and the cable should completely fill the passageway through the cylindrical sliding edge. This insures that the anchoring screws 41 transfer stress between sliders and cables in shear rather than as (bending) beam. The front wall of the hollow cylindrical sliding edge 35 need be of only sufficient thickness to capture and restrain the screw heads 40 in order to insure that is stress transferred in shear from the cable to the piercing screws 41.

To further assure effective stress transfer between the cable 21, screws 41 and slider 34, it is desirable to have the conical screw heads 40 seat into the body of the cable 21 to maintain the cable 21 in snug engagement with the interior wall of the passageway adjacent the necked section 43. The thickened walls of the hollow cylindrical sliding edge 35 at the junction with the necked section resist the forces tending to pull the cylindrical sliding edge 35 from the longitudinal slot of the "C" channel of the track 21.

It is also possible to effectively enhance the stress transfer between the cable 21 and the slider 34 by introducing a flexible glue or epoxy matrix into the void spaces between the cable 21 and cylindrical passageway of the sliding edge 34. However, while such glue or epoxy would establish a bond between the cable and the the effectiveness of such bond would decrease over time because of contraction and expansion of the cable 21 as it subjected to varying tension loads during extension and retraction of the cover. Also, glue or epoxy matrix would interfere with subsequent adjustment of the slider 34 on the cable 21 as discussed later.

As shown in FIGS. 7–12, a slot 39 is cut through the main body 44 of the slider 34 oriented perpendicularly with respect to the cylindrical sliding edge 35. A pin or bolt 38 extends up through the slot 39 and through one of the holes 52 drilled through the tip of the connecting plate 37 A conventional nut 67 helically threads onto the extending end of the bolt 38 and is tightened sufficiently to hold the adjoining flat surfaces of the connecting plate 37 and slider 34 in sliding engagement. Accordingly, the boom 14 can translate longitudinally relative to the sliders 34 coupled at its ends. Such translation is necessary in order to accommodate variations in the distance between the parallel tracks mounted along the sides of the pool, and to accommodate effective shortening of the distance between the coupling points of the boom 14 due to intermittent transverse canting (skewing) and/or bowing of the boom during extension and retraction of the cover 11. Without such a mechanism to allow for variations of distance between the sliders 34 and the effective shortening of the distance between the coupling due to of the boom 14, upon a widening of the transverse distance or a skewing or bowing of the boom 14, the cylindrical sliding edges 35 of the sliders 34 would jam into the longitudinal slot openings of the "C" channels 20 of the track 21 either bending the track, breaking the sliding cylindrical sliding edge 35 away from the main body 44 of the slider 34, or wedging the cylindrical sliding edge 35 out of the "C" channel of the track. Such jamming could also result in the front edge 13 of the cover 11 ripping free of the boom 14.

The main body 44 of the slider 34 also provides a flat platform for supporting the weight of the boom 14 and the front edge of the cover 11 billowing down to the water surface from the "C" channel 46. The platform provided by the main body 44 of the slider 34 should be of sufficient length (measured parallel to the cylindrical sliding edge 35) to afford effective transfer of any torsion stresses tending to twist the boom 14 about its longitudinal axis.

To explain, the wide connecting plate 37 flatly engages the top surface of the main body 44 of the slider 34. The bolt 38 snugging the surfaces together maintains that engagement. Any torsion stress tending to twist the boom 14 about its longitudinal axis is therefore transferred by the wide connecting plate to the main body 44 of the slider 34 which tends to rotate it about a horizontal axis. Also, because of design constraints, the opposing stresses imparted to the slider 34 by the cable 21, on the one hand, and by the bolt 38 and connecting plate 37, on the other hand, are not aligned. Accordingly, a torsion stress is induced tending to rotate the slider 34 about a vertical axis. The above described torsion stresses are initially resisted by the tension stresses acting along the cables 21 and, ultimately, by engagement of the cylindrical sliding edge 35 and/or the necked section 43 of the slider 34 with the confining walls of the longitudinal "C" channel 20 of the track.

In order to minimize such induced torsional stresses tending to twist the slider 34 both horizontally and vertically, every effort should be made, consistent with principles of prudent engineering design, to minimize the perpendicular distance between the cables 21 (anchored to the sliders 34 within the "C" channels of the tracks 19) and the effective coupling point of the boom 14 to the slider 34. And, by using the adjustment slots 51 of the connecting plates 37, the effective length of the boom 14 should be adjusted such that, at the narrowest point between the tracks 19, the bolt 38 translating in the respective slots 39 of the sliders 34 are located at the ends of the respective slots 39 closest to the cylindrical sliding edges 35 slightly compressing the respective cylindrical sliding edges 35 against the back walls of the respective "C" channels.

Increasing the length of the cylindrical sliding edge 35 of the slider 34 sliding within the "C" channel 20, increases the capacity of the slider to to carry or resist such torsional stresses, i.e. increases the moment arm acted on by the tension stresses provided by the cable 21 resisting such torsion stresses. In fact, the tension on the cable 21 establishes and assures alignment of the cylindrical sliding edge 35 within the "C" channel of the track 19. It should be appreciated that the pre-tension load on the cable paths can also be be adjusted upward by utilizing the ratcheting mechanisms to increase the capacity of the slider 34 to carry or resist stresses tending to move the cylindrical sliding edge out of alignment in the track "C" channel 20. It should also be appreciated that to the extent such torsion stresses increase the frictional resistance of the cylindrical sliding edge 35 in the "C" channel 20 of the track 19, the tension in the respective cable paths increases to provide a restoring force tending to realign the cylindrical sliding edge 35 again in the "C" channel.

Also, from purely mechanical considerations, independent of the stresses involved, the longer the cylindrical sliding edge 35 sliding within the "C" channel 20, the less likelihood that it will jam in the "C" channel 20.

Figure 11:
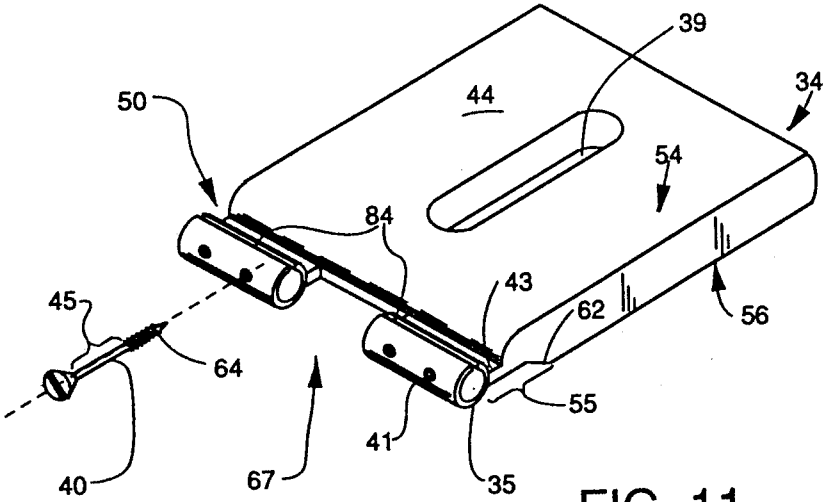
FIG. 11 is a perspective illustration of an embodiment of a slider for the invented leading edge and slider system having a section of the cylindrical sliding edge and a longitudinal cable access slot cut into the hollow cylindrical sliding edge adapting it to be slipped onto and anchored to an existing cable of an automatic pool cover system.

However, it is also desirable to minimize the frictional resistance of the cylindrical sliding edge 35 of the slider 34 sliding within the "C" channel 20 of the track 21 which increases in proportion to the engaged surface area between the cylindrical sliding edge 34 and the capturing "C" channel 20. Also small undulations in the "C" channel 20 limit the length of the cylindrical sliding edge 35, i.e., a long sliding edge will not slide around small curves in the confining "C" channel 20 without jamming. By removing a central section or notch 67 of the cylindrical sliding edge 35 between anchoring screws 41 as illustrated in FIG. 11 it is possible to decrease frictional resistance and enable the slider to tolerate small undulations in the confining "C" channel, and yet retain the benefits of a long sliding cylindrical sliding edge, discussed above.

The sliders 34 should be composed of a material having tough and resilient properties which are not degraded by pool chemicals or by ultraviolet frequencies of sun light. Self lubricating properties are also desirable. The material should also be slightly softer than the extruded Aluminum of conventional swimming pool track such that the cylindrical sliding edge 35 and necked section 43 of the slider 34 wears and not the "C" channel 20 of the track 21. Suitable slider materials include the acetal homopolymer and copolymer plastics such as black DELRIN manufactured by E. I. DuPont Company which incorporates carbon black as an ultraviolet opaquing substance into its matrix.

The slider 34 also provides a means for connecting a new cable 21 to the beaded tape edge 22 of the cover 11. In particular, with reference to FIGS. 1 and 2, the ratcheting mechanism can be released relieving the tension and allowing slack the cables 21. The sliders 34 are then pulled out of the "C" channels of the track 21 either at the the distal ends or adjacent the cover drum 12. The screws 41 anchoring the slider 34 to the cable are then removed and the slider 34 is slid on the cable 21 toward the cover 11. The old or existing cable 21 connecting to the take-up reels 16 (FIG. 1) is then severed, pulled out of the hollow cylindrical sliding edge 35 of the slider 34, disconnected from the take-up reels 16 and removed from the system. The slider 34 is then slid back up the cable 21 until its severed stub is located in about the middle of the hollow cylindrical sliding edge 35 whereupon it is again anchored in position with the smooth shank screws 41. The end of the new cable 21 is inserted into the hollow cylindrical sliding edge 35 until it abuts against the end of the severed cable. The smooth shank screws 41 are then utilized to anchor the slider 34 to the portion of the new cable within its hollow cylindrical sliding edge 35. The cylindrical sliding edge 35 so anchored to the new cable 21 is inserted back into the "C" channel 20 of the track 21.

Figure 12:
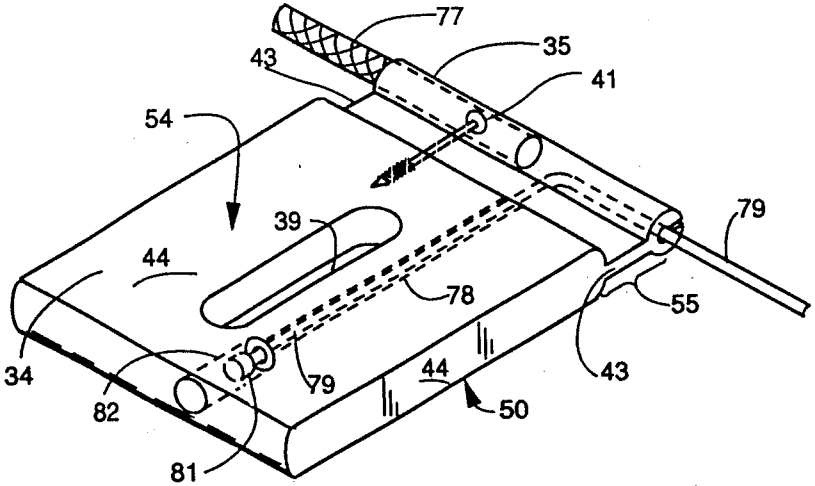
FIG. 12 is a perspective illustration of another embodiment of a slider modified to establish a junction between a conventional rope cable extending from the beaded tape edge of a swimming pool cover and a wire cable extending within the track ultimately connecting to the take-up reels of the system.

It should be appreciated that the slider 34 also provides a means for utilizing different types of cables in automatic pool cover systems, one type for the beaded tape edge 22 of the cover 11, e.g., a Dacron line, and another type connecting to the take-up reels 16, e.g. small diameter steel cable. In particular, as shown in FIG. 12, the line 77 from the cover 11 is inserted partway through the hollow cylindrical sliding edge 35 of the slider 34 and anchored utilizing the smooth shank screws 41. A transverse passageway 78 is drilled through the main body 44 and necked section 43 of the slider 34 to perpendicularly intersect with the cylindrical passageway through the hollow cylindrical sliding edge 35. A small diameter steel cable 79 with a stop 81 fastened at its end is introduced via the passageway 77, pushed through the passageway 77, out the cylindrical passageway of the cylindrical sliding edge to ultimately connect and wind on a take-up reel 16 (FIG. 1). The transverse passageway 77 may have a section 82 of a larger diameter at the back edge of the slider opposite the cylindrical sliding edge 35 to accommodate the stop 81.

Figure 12A:
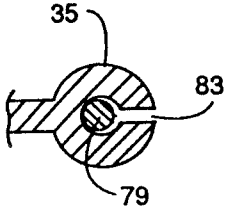
FIG. 12*a* is an enlarged cross-section view of the cylindrical sliding edge of the slider shown in FIG. 12.

Alternatively, a longitudinal slot 83 can be cut into the cylindrical sliding edge 35 of the slider (FIG. 12*a*) and a transverse passageway 77 drilled completely through the cylindrical sliding edge 35 intersecting with the slot 83. The steel cable 79 is then introduced into the transverse passageway 78 from the cylindrical sliding edge 35 until its end protrudes from the transverse passageway 78 at the back edge of the slider 34 whereupon a stop is fastened to the protruding end. The cable 79 is then introduced into the interior of the cylindrical sliding edge 35 via the slot 83 and is ultimately connected and wound on a take-up reel 16.

It should be also be appreciated from the above description that the cylindrical passageway through the cylindrical sliding edge 35 of the slider 34 may have different diameter sections to provide a means for joining different diameter lines or cables.

A worn or broken slider 34 may also easily be replaced on an existing cable 21. In particular, with reference to FIGS. 1 and 11, the broken slider is pulled out of the "C" channels 20 of the track 21 either at the the distal ends or adjacent the cover drum 12. Depending on the system, it may not be necessary to relieve the tension and provide slack in the cables 21 by releasing the ratcheting mechanism, provided the slider 34 can be pulled free of the "C" channel 20 at either end of the track 19. The broken slider 34 is removed from the cable 21. A longitudinal slot 84 is cut into the top of the cylindrical sliding edge 35 of the new slider 34 (FIG. 11) to establish communication with the interior passageway. The cable 21 is then introduced into the hollow cylindrical sliding edge 35 of the new slider 34 via the slot 84 and anchored in position on the cable 21 with the smooth shank screws 41. As depicted in FIG. 11 the central section of the cylindrical sliding edge 35 has been removed or "notched" to reduce the frictional drag of the slider 34 moving within the "C" channel 20 of the track 19 as discussed above.

The ability to translate the sliders 34 on the cables 21 also affords a unique mechanism for maintaining the leading front corners 91 of the cover 11 relatively taunt such that they do not billow or drape down to drag on the surface of the pool deck as the cover 11 is extended and retracted. In particular, referring to FIGS. 2 and 4, the direct anchoring of the sliders 34 to the cables 21 eliminates any necessity for stress transfer via the cover 13 between the cables and the boom 14. Accordingly, it is possible to tailor a cover 11 with a convex front edge 13 to the cover 11 which, when, captured in the linear "C" channel 46, allows the central region 92 of the cover 11 to droop or billow down to be supported by the water in the pool during extension and retraction while maintaining a relative tension in the cover 11 along the side regions 94. By cutting out scallops 96 at the front corners of the cover, it is possible the adjust the degree of differential tension between the central region 92 and the side regions 94 of the cover 11 by translating the anchor positions of the sliders 34 toward and away from the cover 11.

In addition, the ability to translate the anchor positions of the slider 34 on the cables affords means for compensating for shrinkage in cover length, whether uniform or not, a means for grossly adjusting the cant of the bottom 14 to square with the cover drum 12 and pool parameters, and a means for compensating for stretch of the cables 21 incorporated into the beaded tape edges 22.

Figure 9:
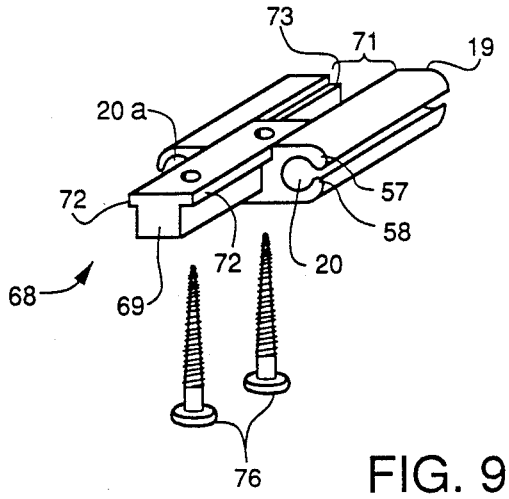
FIG. 9 is perspective illustration of a junction piece for placement between two pieces of conventional under "C" channel track for assuring alignment of the "C" channel at the track junction.

As shown in FIG. 9, to prevent jamming of the cylindrical sliding edge 35 of the slider 34 in the "C" channel of the track 21 due to slight misalignments of the "C" channel at the junctions between two tracks 21 a third junction piece 68 is utilized. Such misalignments often result from irregularities in the surface to which the respective tracks 21 are secured. The junction piece 68 has a "T" shaped cross-section with a thick rectangular stem 69 adapted to be snugly inserted into the rectangular space 71 between the "C" channel 20 and return channel 20*a* of extruded track 21. The extending shoulders 72 provided by the cross-bar of the "T" shaped piece 68 are dimensioned to engage internal shoulders 73 located within the rectangular space 71 of the extruded track 21 between the respective channels 20 and 20a. [See FIGS. 7 and 8]. The cross-section dimension of the stem section 69 of the "T" shaped piece 68 is chosen to snugly fit between the internal shoulders 73 of the track 21, and the thickness dimension of the shoulders 72 of the cross-bar is chosen to be slightly greater than the distance from the internal shoulders 73 to the base 74 of the track 21. Assuming a common extrusion die for the respective tracks 21 at the junction, the rectangular space 71 between the "C" channels 20 of the two tracks will have identical dimensions. Accordingly, the the two tracks are slipped onto the junction piece 68 in an abutting relationship. The the stem 69 of the "T" shaped piece assures alignment of the respective "C" channels horizontally, while the shoulders of 72 of the cross-bar assures alignment of the respective "C" channels vertically. The abutting ends of the tracks 21 with the junction piece 68 are then secured to the swimming pool deck or to the underside of an overhanging pool coping by screws 76.

A further modification is required to adapt the invented leading edge and slider system to automatic pool cover systems which have clutching and braking mechanisms of the type pioneered by Lamb, (See U.S. Pat. No. 4,060,860, Lamb). In contrast to the floating spring tensioning take-up mechanisms of the type pioneered by Last, the applicant herein, under the Patents obtained by Foster, clutch and brake type automatic pool cover systems require a mechanism to compensate for differences in the rates at which the cables 21 wind around the respective cable take-up reels 16 during cover extension. (The take-up reels 16 free wheel during retraction.)

In particular, with reference to FIG. 1, the diameter of a cable wind around the respective take-up reels 16 frequently differ, depending on the distribution of the cable coil layers around the reel. More cable 21 is wound around the reel 16 of the larger diameter than the smaller in a single rotation, a fact which would cause the boom 14 to skew jamming the cylindrical sliding edges 35 of the attached sliders 34 in one or the other of the "C" channels of the track 21.

To correct this problem, a floating pair of coupled pulleys 101 are incorporated into the respective cable paths 102 (shown in phantom in FIG. 1) between the take-up reels 16 and tracks 21. In operation, the couple pulleys 101 will translate toward the larger diameter take-up reel 16 lengthening the cable path for the cable 21 being wound around the other smaller diameter take-up reel 16 thereby counter balancing or compensating for the difference in cable lengths being wound around the respective take-up reels in any single rotation. The friction resistance of cover being drawn across the pool is both of sufficient symmetry and magnitude to provide the necessary tensile force for floating the coupled pair of pulleys and for maintaining square alignment of the boom 14 between the tracks 19 as it moves across the pool.

It should also be appreciated, that like the floating spring 24 and pulleys 26 at its ends in the previously described system, the coupled pair of pulleys 101 equalize the tension loads on the respective cable paths which tends to maintain square alignment of the rigid boom during extension. During cover retraction, the braking mechanisms restraining the free wheeling take-up reels as the cables unwind, provide the necessary tension in the respective cable paths to float the coupled pulleys 101. As during cover extension, the coupled pulleys 101 again equalize the tension loads in the cable paths to minimize cover biasing for insuring square wind-up of the cover around the cover drum during retraction.

Finally, since the rotation of the take-up reels and cover drum are decouple except for the cables, it is possible for slack to develop in the cable paths particularly during retraction. In such an event, to preclude twisting of the cable paths between the pulleys 102 and the coupled pulleys 101, it maybe necessary to secure the coupled pulleys to a conventional sliding track (not shown). Such a sliding track could also serve to limit the translation of the coupled pulleys 101 between the pulleys 102 incorporating the coupled pulleys into the respective cable paths.

To further improve the performance in such clutch type pool cover systems, the pair of pulleys 101 may be coupled together with a tension spring in the manner previously described in context of the automatic pool cover systems utilizing floating spring tensioning take-up mechanisms. To explain, in clutch type pool cover systems, the maximum tension load on the respective cable paths occurs upon initiation of the extension cycle, when, in addition to the frictional resistance of the sliders and beaded tape edges in the "C" channels of the track, the drive mechanism, via the cables must overcome the inertial resistance of the cover drum with a fully wound up cover. (The cover drum free wheels when the take-up reels are rotatably driven to wind up the cables.) Since such clutch mechanisms tend to free wheel between the respective engagement positions with the cover drum and take-up reels, the result is a shock load in the respective cable paths. Such shock loading frequently lead to mechanical and fatigue failures, and, in fact, necessitate the use of shear pins in the drive train to prevent catastrophic failure. Incorporating a tensioning spring to couple the pair of pulleys 101 provides the necessary resiliency in the cable paths to prevent such shock loading and at the same time provide a mechanism of increasing tension load on the cable paths to overcome the initial inertial resistance of the fully loaded cover drum.

In both the floating spring tensioning take-up and clutch and brake pool cover systems, the length of the slot 39 cut through the main body 44 of the slider 34 determines the extent to which the floating spring 24 with pulleys 26 and the floating pair of coupled pulleys 101, respectively, can translate between the take-up reels 16. In particular, should one of the cable paths become jammed, for example, during cover extension, the free cable path will continue to move and even accelerate, translating the floating coupling toward the take-up reel with the jammed cable path. Accordingly, the rigid boom will skew transversely until the respective connecting bolts 38 translate to the ends of the respective slots 39. At that point, the boom 14 generates a tensile stress tending to pull the cylindrical sliding edges 35 of the respective sliders 34 into engagement with the confining lips 57 and 58 defining the longitudinal slot openings of the "C" channels in the track 19 greatly increasing the frictional resistance and jamming the free cable path, over loading and stopping the driving mechanism. If a jam occurs during cover retraction, the same phenomenon occurs with the rigid boom 14, but since the cables are unwinding the floating coupling will translate toward the take-up reel with the free cable path. In either case, it maybe necessary determine and implement a permissible translation distance of the floating coupling between the respective reels 16 relative to the length of the slot 39 to prevent the the floating coupling from striking the pulleys 27/102 incorporating the floating coupling into the cable paths. It also should be recognized that the floating coupling translating between the the incorporating pulleys 27/102 provides a mechanical mechanism to trip limit switches for interrupting power to the driving mechanism stopping extension or retraction of the cover in the event of a jam. Also, it would also be wise to have an overload protection mechanism in the motorized drive 18 to provide additional protection against catastrophic failure in the event of a jam.

Finally, it should be appreciated, that while the floating coupling between the respective cable paths has been described in context of take-up reels located at the respective ends of the cover drum, it should be appreciated both cable reels or a single be cable reel for reeling and unreeling the cables can located at one end of the cover drum without affecting the operation of the floating coupling by a suitable arrangement of the incorporating pulleys.

The invented leading edge and slider system for automatic swimming pool covers has been described in context of both representative and preferred embodiments. There are many modifications and variations which can be made to the invented leading edge and slider system and which, while not exactly described herein, fall within the spirit and the scope of invention as described and set forth in the in the appended claims.

I claim:

1. A leading edge and track slider mechanism for carrying a front edge of a flexible cover above a liquid contained in a pool as the cover, winding and unwinding from a cover drum located at one end of the pool, is drawn back and forth across the pool comprising, in combination, (I.) a rigid structural boom spanning the pool having a planer longitudinal surface with a "C" channel along one edge of the planer surface for receiving and capturing a front beaded edge of the pool cover, (II.) a pair of rigid sliders each captured and sliding within a "C" channel of a pool cover track located along a side edge of the pool;

(III.) attachment means extending from the planer longitudinal surface of the boom at it's ends for establishing a translating and pivoting coupling between the ends of the boom and the sliders, (IV.) means for anchoring each slider to a cable extending from a beaded tape secured to side edges of the pool cover proximate the cover's front corners, each beaded tape edge being captured and sliding within the same "C" channel of the track as a slider, the cables extending from the respective sliders to connect with and wind around at least one rotatable cable take-up reel.

2. The leading edge and track slider mechanism of claim 1 further including a means for maintaining alignment of the rigid boom squarely between the respective tracks.

3. The leading edge and track slider mechanism of claim 2 wherein the means for maintaining alignment of the rigid boom includes a means coupling between the respective cables for compensating for a differential in rates at which cover winds and unwinds from around the cover drum and the respective cables wind and unwind from around the cable take-up reel, and for compensating for a differential in rates at which the respective cables wind and unwind from around the cable take-up reel, the sliders and beaded tape edges sliding within the "C" channels of the respective tracks providing sufficient friction resistance to tension the respective cables, whereby the rigid boom carried by the sliders is maintained squarely between the parallel tracks along each side of the pool.

4. The leading edge and track slider mechanism of claim 2 or 3 wherein the means coupling between the respective cables comprises, in combination, a coupled pair of pulleys, each cable having a closed loop cable path which incorporates one of the of the pulleys, the coupled pair of pulleys floating between a return position in each cable path between the take-up reel and the respective slider.

5. The leading edge and track slider mechanism of claim 4 wherein each closed loop cable path at least incorporates, in sequence:

(a) a rotatable cover drum located at one end of the pool to which the pool cover is attached and winds;

(b) the beaded tape edge of the pool cover;

(c) the slider;

(d) an end pulley located at a distal end of one of the tracks relative to the cover drum for directing the cable into a return channel within the pool cover track adjacent the "C" channel;

(e) a corner pulley located proximate the cover drum aligned with the track return channel for directing the cable from the return channel to one of the pulleys of the coupled pair of pulleys;

(f) one of the pulleys of the coupled pair of pulleys;

(g) a reel pulley receiving the cable from the pulley of the coupled pair of pulleys directing the cable from the return pulley onto the take-up reel; and (h) the take-up reel, whereby, the coupled pair of pulleys are suspended and translate between the respective reel pulleys of the respective cables to lengthen and shorten the respective cable paths compensating for any differential in the respective rates at which the respective cables wind around the cable take-up reel when it is rotated, and whereby, the tension load on one closed loop cable path is inherently transferred to the other cable path, thereby equalizing the tension load on the respective closed loop cable paths.

6. The leading edge and track slider mechanism of claim 5 and further including a return pulley incorporated into each closed loop cable path receiving the cable from the pulley of the floating pair of coupled pulleys directing it to the reel pulley whereby the coupled pair of pulleys float between the return pulleys.

7. The leading edge and track slider mechanism of claim 5 wherein the take-up reel and the cover drum rotate about the same axis, and further including:

(i) a reversible driving means for rotating the cover drum and the take-up reel; and (j) a clutching mechanism for de-coupling the driving means from the cover drum and rotating the take-up reel in a first direction for winding up the cables to pull the cover across to cover the pool, and for de-coupling the take-up reel from the driving means and rotating the cover drum in a direction opposite the first direction to wind the cover around the cover drum retracting the cover from across to uncover the pool.

8. The leading edge and track slider mechanism of claim 7 wherein the coupling between the coupled pair of pulleys comprises a helical tensioning spring.

9. The leading edge and track slider mechanism of claim 5: and further including:

(i) a common axle, the take-up reel and the cover drum each supported by and rotatable with the axle;

(j) a reversible driving means for rotating the common axle rotating the cover drum and the take-up reel, the cables unwinding from the take-up reel and the pool cover winding around the cover drum when the driving means rotates the axle in a first direction, the cables winding around the take-up reel and the pool cover unwinding from the cover drum when the driving means rotates the axle in the a direction opposite to the first direction; and (k) a helical tension spring coupling between the coupled pair pulleys for taking up and yielding slack in the respective cables as necessary to allow for differential travel between the cables and the cover and between the cables as they wind and unwind respectively.

10. The leading edge and track slider mechanism of claim 9 further including a releasable ratcheting means coupling between the take-up reel and the common axle for allowing the take-up reel to rotate on the axle in a direction for winding up the cables expanding the helical tensioning spring pre-tensioning the cable paths.

11. The leading edge and track slider mechanism of claim 2 wherein the means for maintaining alignment of the rigid boom squarely between the respective tracks includes means coupling between the respective cables for increasing and decreasing lengths of the respective cables between each slider and take-up reel corresponding to the difference between the respective lengths of cable wound around the cable take-up reel per rotation and for inherently equalizing tension load on the respective cables.

12. The leading edge and track slider mechanism of claim 1 wherein the rigid sliders captured and sliding within the "C" channels of the pool cover tracks each provides a main body, a cylindrical sliding edge adapted for capture and sliding within the "C" channel of the track, and a necked section of reduced thickness joining between the main body and the cylindrical sliding edge.

13. The leading edge and track slider mechanism of claim 12 wherein the necked sections of the sliders have a thickness dimensioned to loosely fit between opposing lips of the "C" channel defining it's longitudinal slot opening.

14. The leading edge and track slider mechanism of claim 13 wherein the means extending from the planer longitudinal surface of th boom at it's ends for establishing a translating and pivoting coupling between the ends of the boom and the sliders also restrains rotation of the boom about its longitudinal axis.

15. The leading edge and track slider mechanism of claim 13 wherein:

(a) the main body of each slider presents a flat engagement surface coplaner with the cylindrical sliding edge for engagement with the means extending from the planer longitudinal surface at the ends of the boom; and (b) a centrally located translation slot oriented perpendicularly relative to the cylindrical sliding edge is cut into the flat surface and through the main body of each slider; and wherein the attachment means extending from the planer longitudinal surface at each end of the boom includes:

(c) a flat surface oriented for engagement with the flat engagement surface presented by the main body of the slider;

(d) a pinning means extending through and translatable in the translation slot for loosely snugging the flat surface of the attachment means against the flat engagement surface of the main body of the slider establishing a translatable and pivotable coupling between the ends of the boom and the sliders which restrain rotation of the boom about its longitudinal axis; whereby the sliders can translate relative to the ends of the boom to accommodate small variations in the distance between the tracks located along the side edges of the pool, and the boom can both skew and bow transversely between the tracks within limits defined by the translation slot's length.

16. The leading edge and track slider mechanism of claim 13 wherein:

(a) the main body of each slider presents a flat engagement surface coplaner with the cylindrical sliding edge for engagement with the means extending from the planer longitudinal surface at the ends of the boom; and (b) a centrally located translation slot oriented perpendicularly relative to the cylindrical sliding edge is cut into the flat surface and through the main body of a first sliders, the remaining second slider having a cylindrical pinning hole extending into the flat surface and through its main body; and wherein the attachment means extending from the planer longitudinal surface at each end of the boom includes:

(c) a flat surface oriented for engagement with the flat engagement surface presented by the main body of the sliders;

(d) a pinning means extending through and translatable in the translation slot of the first slider and extending through the pinning hole of the second slider for loosely snugging the flat surfaces of the respective attachment means against the flat engagement surfaces of the main bodies of the respective sliders establishing a translatable and pivotable coupling between one end of the boom and one of the sliders and a pivoting coupling between remaining end of the boom and the remaining slider, both of which the which restrain rotation of the boom about its longitudinal axis;

whereby at least one of the sliders can translate relative to the ends of the boom to accommodate small variations in the distance between the tracks located along the side edges of the pool, and the boom can both skew and bow transversely between the tracks within limits defined by the translation slot's length.

17. The leading edge and track slider mechanism of claim 15 or 16 wherein each attachment means further includes, a flat rectangular connecting plate having a front end, a back end and means proximate its front end for receiving the pinning means, and an adjustable means fastening the back end of the connecting plate to the planer longitudinal surface at the end of the boom for adjusting longitudinal extension of the connecting plate beyond the end of the boom.

18. The leading edge and track slider mechanism of claim 17 wherein the adjustable means fastening the back end of each connecting plate to the planer longitudinal surface at the ends of the boom comprises, in combination, at least two slots cut through the connecting plate proximate the back end, each slot being aligned parallel to the longitudinal axis of the boom, and at least two connecting plate screws each adapted to extend through one slot of the connecting plate and having a helical thread penetrating into and anchoring in the boom, whereby, the connecting plate screws can be loosened and the connecting plate translated longitudinally relative to the axis of the boom.

19. The leading edge and track slider mechanism of claim 17 wherein the means proximate the front end of each connecting plate for receiving the pinning means comprises a plurality of cant adjustment holes drilled through the connecting plate along a line perpendicularly oriented with respect to the longitudinal axis of the boom, whereby, transverse cant of the boom spanning across the pool can be adjusted by changing the pinning means loosely snugging the connecting plates to the flat engagement surfaces of the respective sliders from one cant adjustment hole to another.

20. The leading edge and track slider mechanism of claim 17 wherein:

the tracks are secured to a top surface of a horizontal deck adjacent the sides of the pool;

the "C" channel of each track has opposing lips defining its longitudinal slot opening which constrains the slider captured and sliding within that "C" channel to slide in a plane angled upwardly with respect to the top surface; and the connecting plates secured to the longitudinal planer surface at the end of the boom each angle downward with respect to the to surface for flat engagement with the flat engagement surface presented by the main body of the slider.

21. The leading edge and track slider mechanism of claim 17 wherein the main body of each slider has a length measured parallel the cylindrical sliding edge, and wherein the connecting plate has sufficient width to provide an effective moment arm extending from the pinning means for transferring torsion stresses tending to rotate the boom about its longitudinal axis to the slider.

22. The leading edge and track slider mechanism of claim 1 or 14 or 15 wherein the sliders are composed of a material from a class consisting of acetal homopolymer resins and acetal copolymer resins.

23. The leading edge and track slider mechanism of claim 21 further including an ultraviolet opaquing material in the composition of the sliders.

24. The leading edge and track slider mechanism of claim 2, or 23 wherein the rigid boom comprises a hollow cylindrical tube with a planer surface tangentially extending from its circumference along its entire length, the "C" channel for receiving and capturing the front beaded edge of the cover being located along the distal edge of the tangentially extending planer surface, whereby, the attachment means extending therefrom for establishing the translating and pivoting coupling with the sliders are coplaner.

25. The leading edge and track slider mechanism of claim 24 wherein a first distance measured perpendicularly between the plane of the tangential extending surface of the boom and a reference plane longitudinally bisecting the respective "C" channels of the tracks located along the side edges of the pool is minimized, whereby cable tension stresses aligned with the cables and transferred to the ends of the boom via the sliders and attachment means are approximately coplaner with horizontal components of cover tension stresses transferred to the boom along its length by the "C" channel at the edge of the tangentially extending planer surface 26. The leading edge and track slider mechanism of claim 25 wherein a second distance measured perpendicularly between the respective cables anchored to the respective sliders and the pivoting and translating coupling with the sliders established by the attachment means extending from each end of the boom is minimized, whereby induced torsion stresses acting on the sliders due to nonalignment of cable tension stresses transferred to the sliders via the anchoring means, and cover tension stresses transferred to the sliders via the pivoting and translating coupling are minimized.

27. The leading edge and track slider mechanism of claim 26 wherein:

each slider has a cylindrical sliding edge of length sufficient to provide moment arms acted upon by stresses aligned with and imparted by a cable anchored and aligned axially therewith for generating moments of force to resist stresses acting on the boom imparted to the slider via the translating and pivoting coupling tending to rotated the slider about axes aligned and perpendicular to the reference plane; and further including means for pre-tensioning the cables for generating a static force for maintaining alignment of the cylindrical sliding edges of the sliders within the "C" channels of the track.

28. The leading edge and track slider mechanism of claim 27 and further including a cover having a convex front edge enabling the cover to billow longitudinally in its central section down to float on a surface provided by a liquid contained in the pool, while sections of the cover adjacent the beaded tapes secured to the side edges of the pool are maintained in tension as the cover is drawn back and forth across the pool.

29. The leading edge and track slider mechanism of claim 28 wherein the pool cover has concave scallops at its front corners, the front beaded edge of the cover terminating at the scallops, and the beaded tapes secured to the side edges of the pool cover also terminating at the scallops.

30. The leading edge and track slider mechanism of claim 29 wherein the pool cover has a front region of a decreasing transverse dimension between the beaded tapes toward its front edge sufficient for maintaining a slight tension in the front corner regions of the cover between the front beaded edge captured in the "C" channel of the rigid boom and the beaded tape secured to the sides of the pool cover captured and sliding in the respective "C" channels of the tracks.

31. The leading edge and track slider mechanism of claim 30 wherein the pool cover includes at least one mesh screen opening proximate its front edge for allowing liquids trapped exterior the pool cover and within the pool to drain into the pool as the cover is retracted from across the pool.

32. The leading edge and track slider mechanism of claim 31 wherein the mesh screen opening is located in the section of the pool cover which longitudinally billows down from the rigid boom to float on the surface of the liquid in the pool.

33. The leading edge and track slider mechanism of claim 32 wherein a lowest edge of the mesh screen opening is positioned immediately above the surface of the liquid within the pool as the cover extends across the pool.

34. The leading edge and track slider mechanism of claim 31 wherein the mesh screen is welded into the cover material and a float is incorporated into the weld for supporting the mesh screen opening above the liquid surface as the pool cover is extended and retracted back and forth across the pool.

35. The leading edge and track slider mechanism of claim 34 wherein the mesh screen is located within a region at the front end of the cover which raises above the liquid surface of the pool when an object tending to sink into the liquid is supported exterior the cover on the surface of the pool, whereby flow of liquid from the pool onto the exterior surface of the cover is minimized.

36. The leading edge and track slider mechanism of claim 26 wherein:

the hollow cylindrical tube of the boom has a diameter, D, and each slider has a cylindrical sliding edge of length, L, at least equal to D, whereby, moment arms acted upon by stresses aligned with and imparted by a cable anchored and aligned axially therewith generate moments of force to resist stresses acting on the boom imparted to the slider via the coupling tending to rotated the slider.

37. The leading edge and track slider mechanism of claim 24 wherein the sliders are composed of a material from a class consisting of acetal homopolymer resins and acetal copolymer resins.

38. The leading edge and track slider mechanism of claim 12 wherein:

each cylindrical sliding edge includes a passageway aligned with its longitudinal axis;

each cable threads through the passageway of a slider; and the means for anchoring each slider to a cable comprises at least one smooth shank anchoring screw piercing diametrically through the cylindrical sliding edge, through the cable threading the passageway, and through the adjoining necked section to anchor in the main body of the slider.

39. The leading edge and track slider mechanism of claim 38 wherein each smooth shank anchoring screw has:

a shank having (i) a diameter less than the thickness dimension of the necked section of the slider, and (ii) a length greater than a distance measured perpendicularly from the main body of the slider to a distal exterior cylindrical surface of the sliding edge; and a helical threaded section tapering to a point at its distal end of a diameter greater than that of the shank; and a head of a diameter less than the diameter of the cylindrical sliding edge.

40. The leading edge and track slider mechanism of claim 39 wherein:

the diameter of each passageway is dimensioned for compressly engaging the cable threading it;

the anchoring have screw heads conically tapering to the shank, the screw heads being counter sunk embedding in an annular wall of the cylindrical sliding edge between its surface and the passageway, the screw heads partially seating on the cable compressing the cable against a section of the cylindrical sliding edge adjoining the necked section of the slider; whereby stress is transferred between the cable and the anchoring screws and between the sliding edge and the screws in shear.

41. The leading edge and track slider mechanism of claim 38 wherein a central section of the cylindrical sliding edge is removed between two sets of smooth shank anchoring screws.

42. The leading edge and track slider mechanism of claim 38 wherein the passageway is offset from the longitudinal axis of the cylindrical sliding edge away from the adjoining necked section providing a thickened wall in a section of the sliding edge which integrally joins with the necked section.

43. The leading edge and track slider mechanism of claim 38 wherein the heads of the anchoring screws are counter sunk into the cylindrical sliding edge of the slider sufficiently to preclude contact with the "C" channel in which the slider is captured and slides.

44. The leading edge and track slider mechanism of claim 38 wherein the passageway through the cylindrical sliding edge has two sections of different diameters enabling the slider to be anchored between two cables of different diameters, whereby a cable of a type different from that extending from the beaded tape can be sliced into the system for connection between the slider and the take-up reel.

45. The leading edge and track slider mechanism of claim 38 wherein a longitudinal access slot is cut into the cylindrical sliding edge intersecting with the passageway, whereby the slider can be placed on a continuous cable, the cable being introduced into the passageway via the access slot and then anchored within the passageway by means of the smooth shank screws.

46. The leading edge and track slider mechanism of claim 45 wherein the longitudinal access slot is located approximately in a plane oriented perpendicularly relative to a reference plane extending along bisecting the adjoining necked section and passageway, the smooth shank screws diametrically piercing therethrough to anchor in the main body of the slider approximately in the reference plane.

47. The leading edge and track slider mechanism of claim 12 wherein:

a cylindrical sliding edge of a slider includes a first and a second receptacle, each extending into an end of the cylindrical sliding edge aligned with the longitudinal axis of the sliding edge, the first receptacle being adapted to and receiving an end of a first cable extending from the beaded tape, the second receptacle being adapted to and receiving a second, different type of cable extending between the slider and the take-up reel; and the means for anchoring this slider to the respective cable comprises, in combination, at least one smooth shank anchoring screw piercing diametrically through the cylindrical sliding edge, through the first cable received in the first receptacle, and through the adjoining necked section to anchor in the main body of the slider, a cable anchoring passageway communicating through the main body of the slider, and through the necked section to perpendicularly intersect with the second receptacle, an end of the second cable extending into the second receptacle, then at a right angle through and out the anchoring passageway, and stop means secured to the end of the second cable extending out the anchoring passageway for preventing that end of the second cable from slipping out of the anchoring passageway.

48. The leading edge and track slider mechanism of claim 12 wherein:

a cylindrical sliding edge of a slider includes a first and a second receptacle, each extending into an end of the cylindrical sliding edge and aligned with the longitudinal axis of the sliding edge, the first receptacle being adapted to and receiving an end of a first cable extending from the beaded tape, the second receptacle being adapted to and receiving a second cable extending between the slider and the take-up reel; and the means for anchoring this slider to the respective cable comprises, in combination, a first and second cable anchoring passageway each communicating through the main body of the slider, and through the necked section to perpendicularly intersect with the first and second receptacles respectively, an end of the first and second cable respectively extending into the first and second receptacles, then at a right angle through and out the respective first and second anchoring passageways, and a stop means secured to each of the ends of the first and second cables extending out the anchoring passageways for preventing the end of the particular cable from slipping out of the particular anchoring passageway.

49. The leading edge and track slider mechanism of claim 48 wherein:

the first and second receptacles are coaxial; and a cable access slot also aligned with the longitudinal axis of the cylindrical sliding edge is cut into the sliding edge to communicate with each receptacle along its entire length, whereby the first and cables can be introduced directly into the respective anchoring passageways, and then bend 90° to oppositely extend centrally from the respective ends of the cylindrical sliding edge for connection to the beaded tape and to the cable take-up reel respectively.

50. The leading edge and track slider mechanism of claim 1 wherein the means anchoring each slider to a cable can be released and re-anchored for allowing the sliders to be be translated along the respective cables and re-anchored at new positions for adjusting:

transverse cant of the boom between the tracks and with respect to a cover drum around which the cover winds at one end of the pool and an end edge of the pool opposite the cover drum;

differential tension between the central and side sections of the pool cover; and differential tension between the side sections of the pool cover adjacent the tape side edges; whereby, effects of wear, shrinkage, strain, and stretching of the pool cover, the beaded tape edges, the cables and other components of a mechanical pool covering system accumulating over time which compromise operation of the mechanical pool covering system can be mitigated.

* * * * *

UNITED STATES PATENT AND TRADEMARK OFFICE

CERTIFICATE OF CORRECTION

PATENT NO. : 4,939,798

DATED : Jul. 10, 1990

INVENTOR(S) : Harry J. Last

It is certified that error appears in the above-identified patent and that said Letters Patent is hereby corrected as shown below:

In Claim 4, Column 20, line 12, the claim dependency should be -- 3 or 11-- not --"2 or 3"--;

In Claim 22, Column 23, line 53, the claim dependency should be -- 1 or 15 or 16 -- not -- "1 or 14 or 15"--;

In Claim 23, Column 23, line 57, the claim dependency should be -- 22 -- not -- "21"--; and In Claim 24, Column 23, line 60, the claim dependency should be -- 2 or 14 -- not -- "2 or 23" --.

Signed and Sealed this

Seventeenth Day of September, 1991

*Attest:*

*Attesting Officer*

HARRY F. MANBECK, JR.

*Commissioner of Patents and Trademarks*